US005903445A

United States Patent [19]

Nakamura et al.

[11] Patent Number: 5,903,445

[45] Date of Patent: May 11, 1999

[54] BOX CARRYING INDICIA RELATING TO ITS CONTENTS AND METHOD OF APPLYING THE INDICIA

[75] Inventors: Masayoshi Nakamura; Akihiro Oda, both of Yokkaichi, Japan

[73] Assignee: Sumitomo Wiring Systems, Ltd., Japan

[21] Appl. No.: 08/652,412

[22] Filed: May 23, 1996

[30] Foreign Application Priority Data

May 23, 1995 [JP] Japan ..... 7-124002
Oct. 27, 1995 [JP] Japan ..... 7-303530

[51] Int. Cl.[6] ..... H01H 85/20; G09F 3/00

[52] U.S. Cl. ..... 361/833; 40/312; 206/459.1

[58] Field of Search ..... 361/833, 629, 361/647; 337/206, 262, 168; 40/312; 206/459.1, 459.5, 460; 174/56

[56] References Cited

U.S. PATENT DOCUMENTS 4,801,035 1/1989 Sugiyama et al. .

FOREIGN PATENT DOCUMENTS 76330375 10/1976 Germany .
1468693 7/1974 United Kingdom .

*Primary Examiner*—Leo P. Picard
*Assistant Examiner*—Jayprakash N. Gandhi
*Attorney, Agent, or Firm*—Jordan B. Bierman; Bierman, Muserlian and Lucas

[57] ABSTRACT

A first description of relevant characteristic of electrical elements is applied to a portion of a box containing the elements, preferably when the box is molded. When a second description is needed in lower volume as compared to the first description, a label having the second description is adhered over the first description to provide the desired display as well as to conceal the first description.

8 Claims, 5 Drawing Sheets

BOX CARRYING INDICIA RELATING TO ITS CONTENTS AND METHOD OF APPLYING THE INDICIA

This Application claims the benefit of the priorities of Japanese Applications 7/124002, filed May 23, 1995 and 7/303530, filed Oct. 27, 1995.

The present Invention relates to a cover for an electrical connection box used in connection with an automotive wiring harness and, in particular, to a marked area for inscribing necessary indicia on a cover of a receptacle to indicate the nature of the electrical elements contained therein. The device will be described in connection with a fuse box, but it is understood that it is not so limited. It is useful for any container having electrical elements therein.

BACKGROUND OF THE INVENTION

In a known fuse box, cover 1 is fitted on the receptacle shown in FIG. 7 after the fuses have been inserted. To the upper surface of fuse cover 1, label 2 carrying the desired indicia relating to the individual fuses in the box, is affixed. Specifically, in the present case there are a total of 21 fuses, seven rows arranged in three columns, mounted in the fuse box. Thus, label 2 is in accordance therewith so that sections 2*a* are also arrayed in three columns and seven rows. Indicia 2*b* on label 2 describe each of the fuses in the box. Label 2 is a resin sheet and has an adhesive applied to the rear surface thereof so that it can be readily adhered to cover 1.

The foregoing construction suffers from certain defects. If labels 2 are to be affixed to covers 1, it is necessary that each individual cover receive a label. When a particular model automobile is produced in very large numbers, each car must have an identical label manually adhered to its fuse box. This takes considerable time and is consequently expensive.

SUMMARY OF THE INVENTION

The present Invention is intended to overcome the drawbacks of the prior art. In particular, it is an object of the present Invention to eliminate the necessity for individual adherence of labels on the fuse boxes of automobiles which are manufactured in large numbers. At the same time, it is desired to provide a means whereby models, produced in substantially smaller numbers, can have suitable labels on the fuse boxes installed therein.

According to the Invention there is provided a cover for the fuse box wherein a first set of indicia describing each fuse individually is provided in a marked area on the outer surface of the cover. If a different model is produced, different fuses will be required. If this model is produced in small quantities, rather than create a new mold or stamping to form a different fuse box cover, a label, having a second set of indicia, is adhered to the outer surface of the marked area, thereby both obscuring the first set of indicia and providing the second set for the information of the owner or mechanic. According to a preferred embodiment, the marked area is in a recess formed in the cover.

Accordingly, if the marked area is formed in the cover when the cover is molded, no label is necessary. Thus, with large volume models, the provision of the marked area reduces the cost of installing the display of the indicia as compared to adhering labels to the covers of the individual boxes. On the other hand, if there is only a small number of vehicles of a particular model, the provision of special covers at the time of molding leads to an increased number of parts. In this case, by adhering the label to the marked area, the indicia thereon are concealed and, at the same time, the correct information is displayed.

Thus, great number of covers to which the same labels were adhered according to the prior art can now be molded with the marked areas on their surfaces. Accordingly, no labels are needed, thereby making the operation more economical. On the other hand, if there are only a small number of vehicles of the same type, covers provided with the above-described marked areas have the labels adhered to the marked areas to conceal the inapplicable marked areas and provide the information. Therefore, the kinds and the number of labels necessary can be reduced, with a corresponding reduction in cost. Advantageously, the label is an opaque resin film printed with the second set of data, and adhered so as to substantially conceal the first set of data; preferably, it is located in the recess. In this case, the label can be easily positioned and is unlikely to be peeled off. More preferably, the marked area is provided on the surface of the cover when the cover is molded.

According to one embodiment of the Invention, the marked area is provided on the front and/or upper surface of the cover. Alternatively, the marked area may be provided on the inner surface of the cover; in that case, the label is adhered to the outer surface thereof. The indicia on the inner surface corresponds to the large production model, and that adhered to the outer surface of the cover relates to the small production model. In this case, since the outer surface is relatively smooth, the label can be easily affixed thereto. Advantageously, the marked surface is engraved, molded, melted, chemically etched, and/or mechanically etched to provide the desired indicia thereon.

BRIEF DESCRIPTION OF THE DRAWINGS

In the accompanying drawings, constituting a part hereof, and in which like reference characters indicate like parts.

FIGS. 1(A), 1(B), 1(C), and 2 to 4 show cover 10 according to the first embodiment of the Invention. As seen in FIG. 2, cover 10 is locked to the upper surface of receptacle 12 of a fuse box by locking members 13 and 14. In the upper surface of cover 10, recess 15, slightly smaller than the upper surface, is formed. Within recess 15 and periphery 16, section lines 17*a* define 21 sections. Desired indicia 17*b*, within section lines 17*a*, are defined by grooves 20 in the bottom surface of recess 15 as shown in FIG. 1(C). More specifically, on the bottom surface, grooves 20 form section lines 17*a*, and indicia 17*b* project as in a relief. Marked area 17, including lines 17*a* and indicia 17*b*, is formed by e.g. engraving, molding, melting, and/or chemical or mechanically etching. It is especially desirable to carry out the foregoing processes when cover 10 is molded.

Figure 1A:
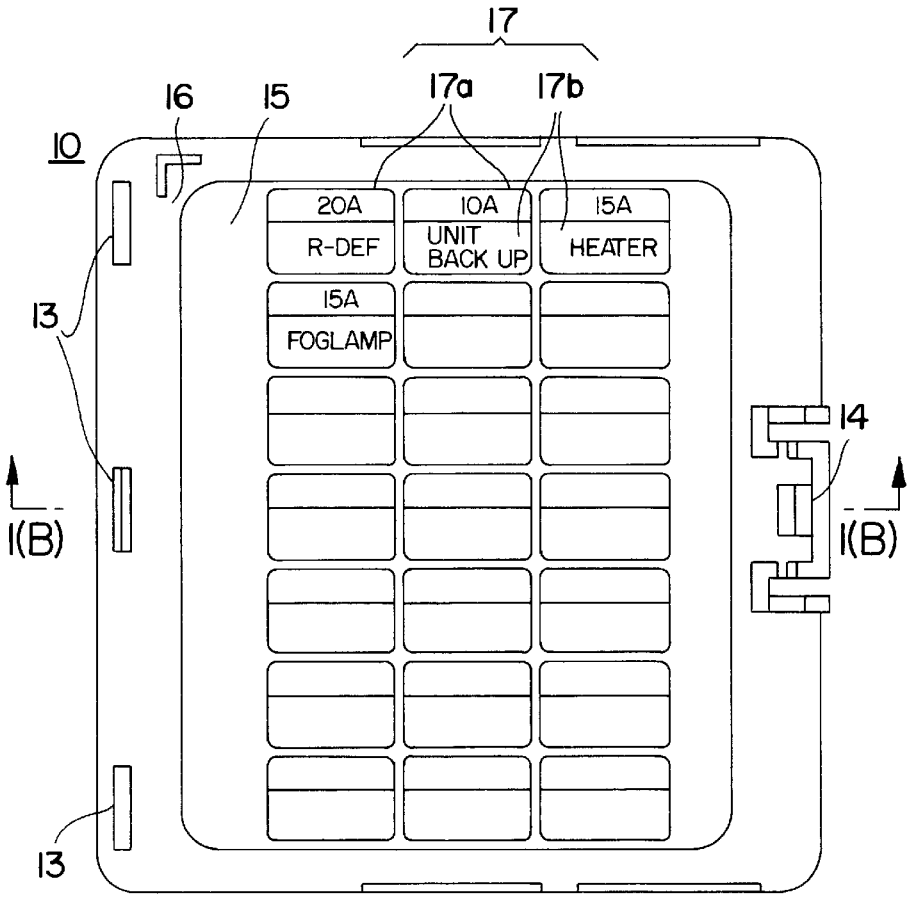
FIG. 1(A) is a plan view of a cover according to the first embodiment of the Invention.
Figure 1B:
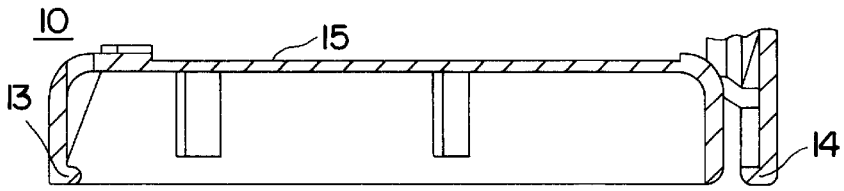
FIG. 1(B) is a section along line 1B—1B of FIG. 1(A)
Figure 1C:
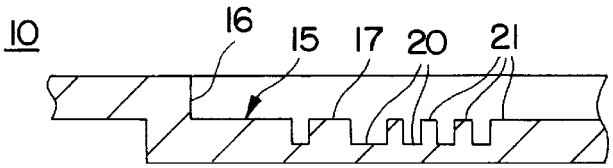
FIG. 1(C) is an enlarged view of the essential portion of FIG. 1(B)
Figure 2:
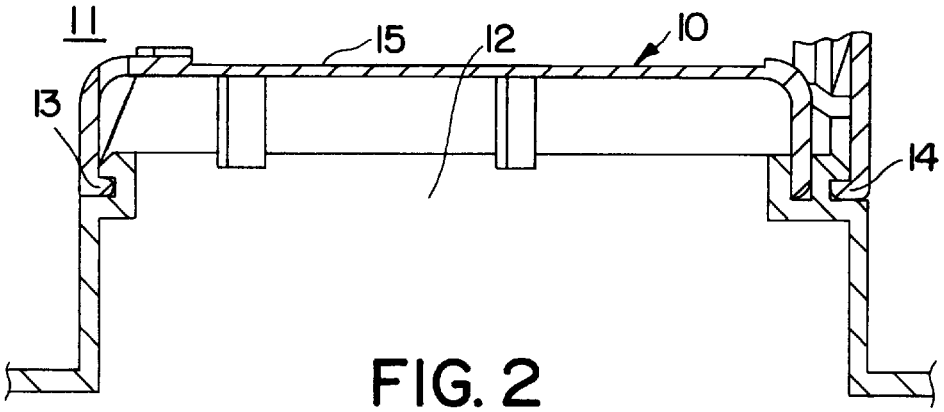
FIG. 2 is a schematic section of a fuse box fitted with the cover of the present Invention.
Figure 3:
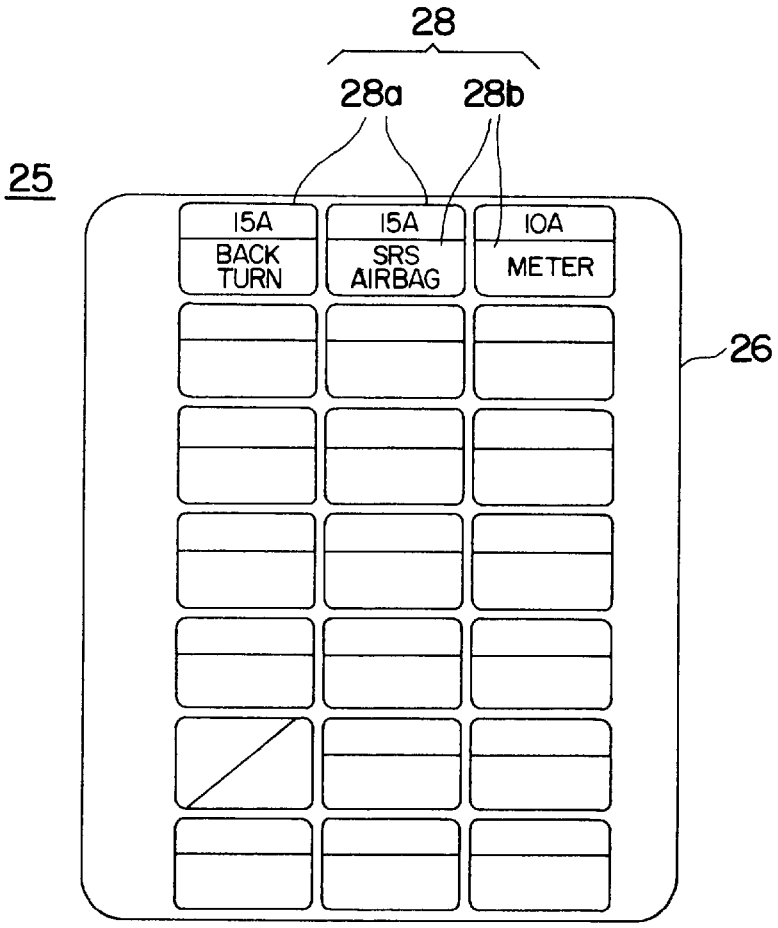
FIG. 3 is a plan view of a label.
Figure 4A:
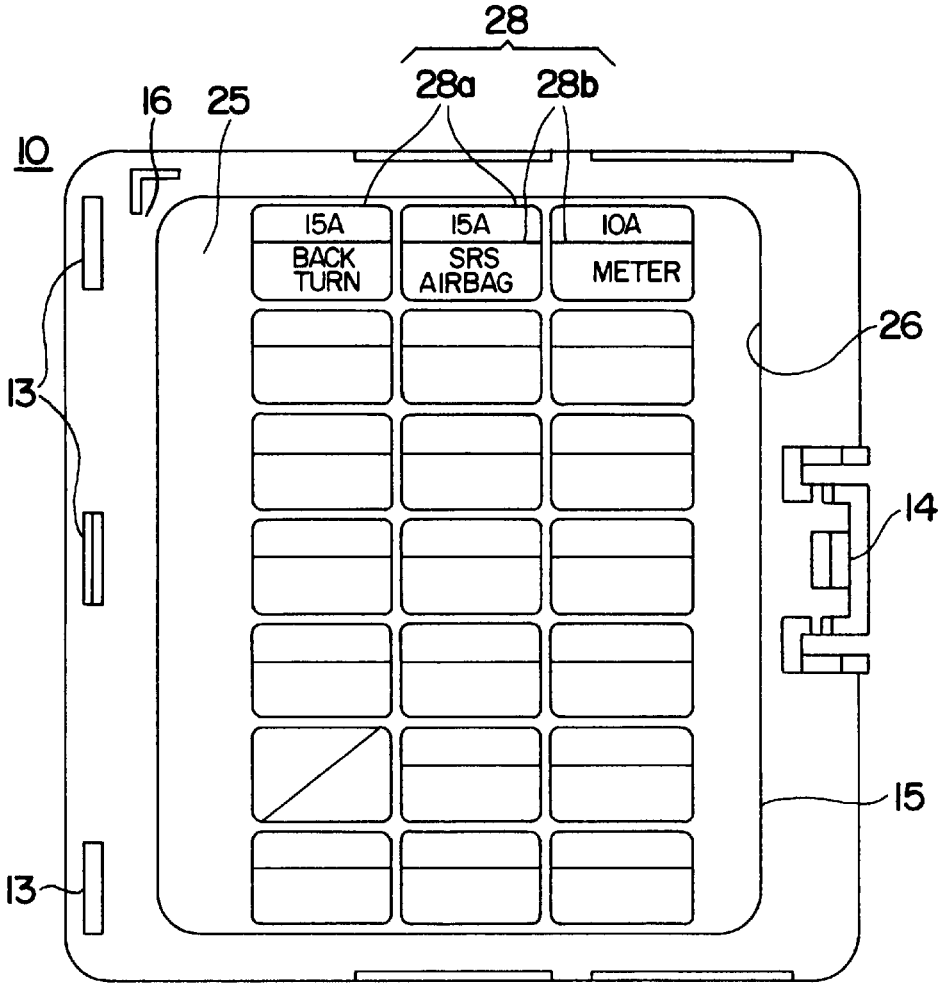
FIG. 4(A) is a plan view of the cover with the label adhered thereto.
Figure 4B:
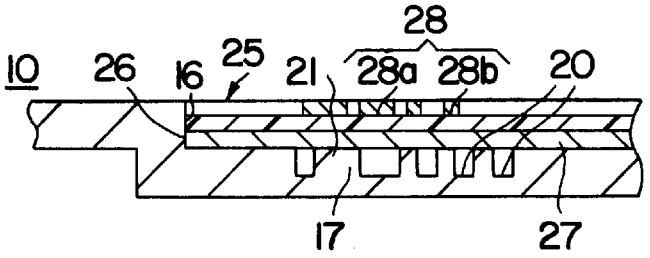
FIG. 4(B) is a section of the essential portion of the cover.

Label 25 fits on the bottom surface of recess 15, and periphery 26 conforms to periphery 16 thereof, so that recess 15 is substantially concealed by label 25. Label 25 is of a resin film, preferably opaque, and has adhesive 27 applied to its back surface. Label 25 is formed by printing inscribed area 28, including section lines 28*a* and indicia 28*b*, corresponding to section lines 17*a* and inscription 17*b*, of marked area 17, on an opaque film. In this embodiment, the film is white and inscribed area 28 is printed in black.

The use of cover 10 obviates the need for adhering labels thereto when the same type of vehicles are mass-produced in large numbers; thus, affixing labels 25 to covers 10 is necessary only for a small production of vehicles. Accordingly, the label adhering operation need be performed a considerably reduced number of times, thereby minimizing both the number and types of labels required.

Figure 5A:
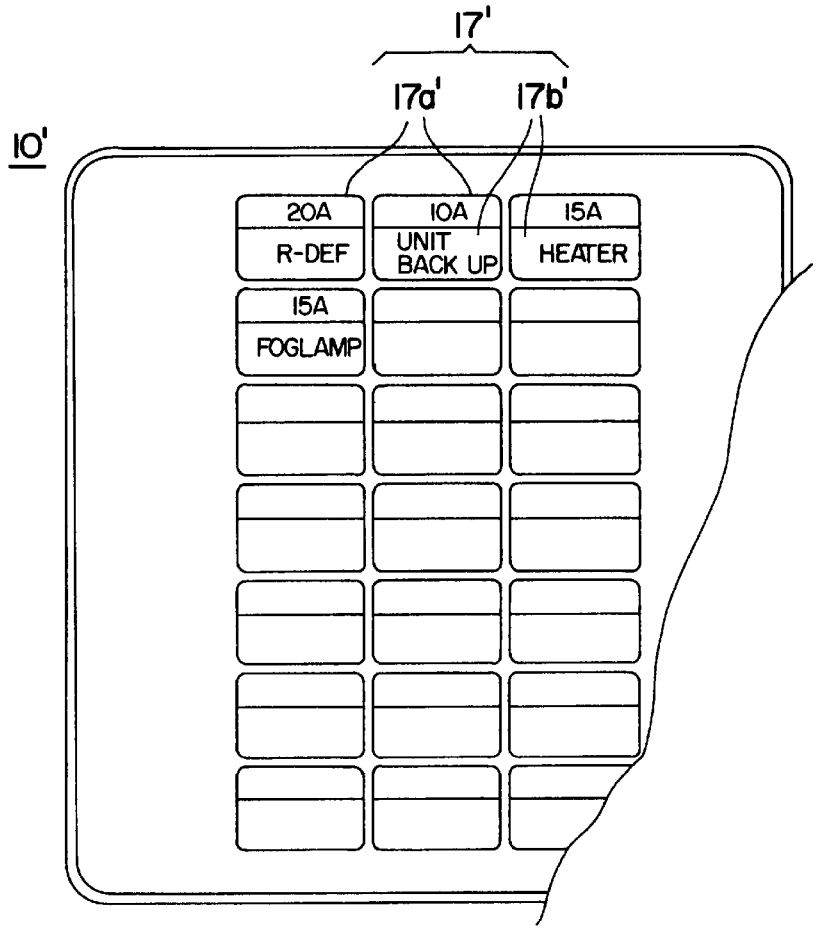
FIG. 5(A) is a bottom view of a cover according to the second embodiment of the Invention.
Figure 5B:
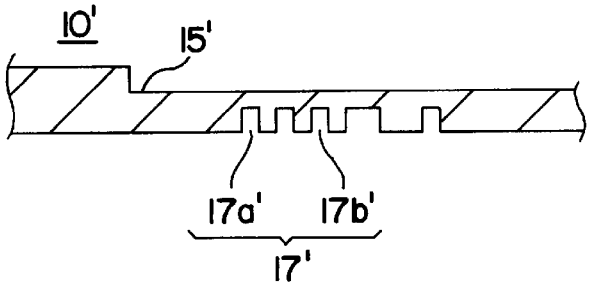
FIG. 5(B) is an enlarged section of the essential portion of this cover.
Figure 6:
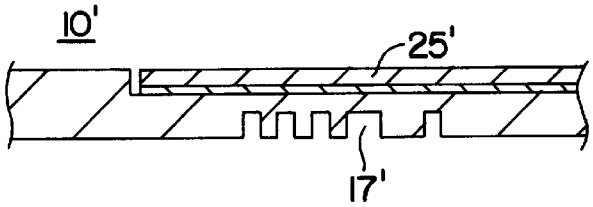
FIG. 6 is a section of the cover according to the second embodiment of the Invention with the label in place.
Figure 7:
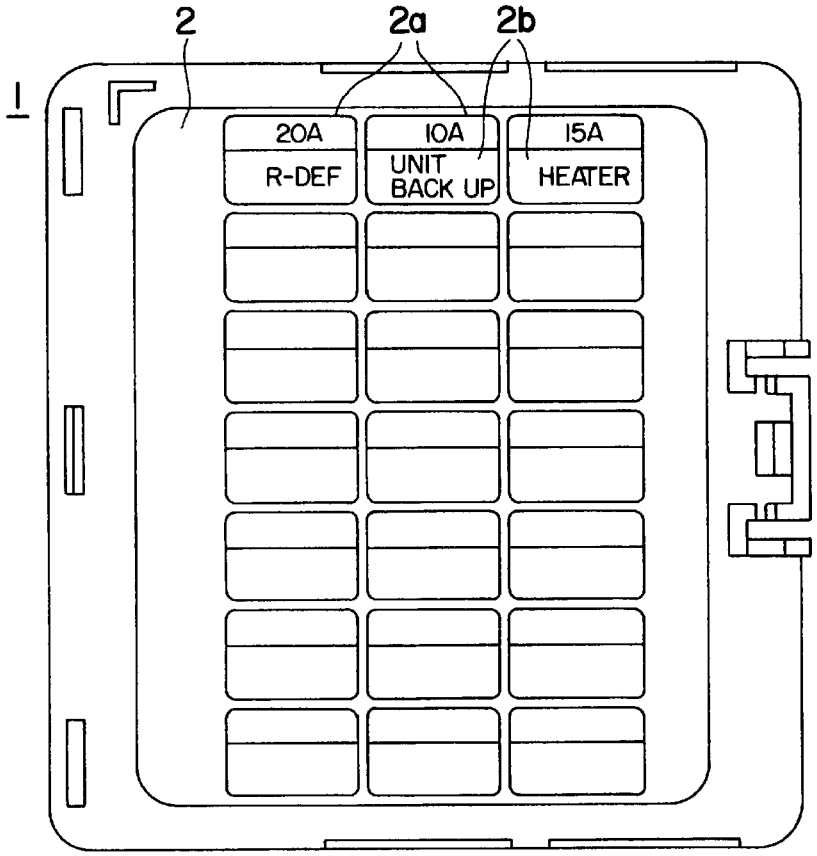
FIG. 7 PRIOR ART
FIG. 7 is a plan view of a prior art cover.

FIGS. 5(A), 5(B), and 6 show a second embodiment of the Invention. Marked area 17', including lines 17*a'* and indicia 17*b'*, is formed e.g. by engraving, molding, melting, chemically etching, and/or mechanically etching the inner surface of cover 10'. It is most desirable to form the area when cover 10' is molded. As in the first embodiment, marked area 17' carries indicia relating to the vehicles produced in large numbers. In this embodiment, recess 15' is formed in the front surface of cover 10'. Recess 15' is slightly smaller than the outer shape of the front surface of cover 10'.

If cover 10' is on a fuse box to be installed in a high volume vehicle, it is used as is without any label. On the other hand, if it is to be mounted on a fuse box for a low volume vehicle, label 25', carrying the appropriate information is adhered to recess 15' on the outer surface of cover 10'. Since the cover according to the second embodiment has no marked area on its front surface, the label mounting operation is made easier and faster.

While only a limited number of specific embodiments of the present Invention have been expressly disclosed, it is, nonetheless, to be broadly construed, and not to be limited except by the character of the clams appended hereto.

What we claim is:

1. A cover for an electrical connection box for mounting electrical devices wherein a first inscription relative to a first group of said devices is provided in at least one area of a surface of said cover, wherein said cover further comprises a label having a second inscription relative to a second group of said devices, said label being adhered to a first surface of said area when said second group of said devices is in said connection box.

2. The box of claim 1 wherein a recess is provided in said portion, said first set of data being in said recess.

3. The box of claim 1 wherein said first set of data is on an outer surface of said box and, when said box is in said second location, said label is on said outer surface.

4. The box of claim 1 wherein said first set of data is on an inner surface of said box and, when said box is in said second location, said label is on an outer surface opposed to said inner surface.

5. The box of claim 4 wherein there is a recess in said outer surface and, when said box is in said second location, said label is in said recess.

6. The cover of claim 1 wherein, when said box contains said second group, said label obscures said data.

7. The cover of claim 1 wherein said label is an opaque resin film, imprinted with said second inscription substantially conceals said first inscription.

8. The cover of claim 1 wherein said first inscription is molded into said cover during manufacture thereof.

* * * * *